US007255572B2

(12) United States Patent
Endo

(10) Patent No.: US 7,255,572 B2
(45) Date of Patent: Aug. 14, 2007

(54) ELECTRICAL CONNECTOR PROVIDED WITH COILED SPRING CONTACT

(75) Inventor: Kenji Endo, Arlington Heights, IL (US)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/215,075

(22) Filed: Aug. 31, 2005

(65) Prior Publication Data

US 2007/0049063 A1 Mar. 1, 2007

(51) Int. Cl.
*H01R 12/00* (2006.01)

(52) U.S. Cl. ..... 439/66

(58) Field of Classification Search ..... 439/66, 439/840, 700, 824
See application file for complete search history.

(56) References Cited

U.S. PATENT DOCUMENTS

| | | | | |
|---|---|---|---|---|
| 4,029,375 | A * | 6/1977 | Gabrielian | 439/66 |
| 5,007,842 | A | 4/1991 | Deak et al. | 439/66 |
| 5,030,109 | A * | 7/1991 | Dery | 439/66 |
| 5,109,596 | A * | 5/1992 | Driller et al. | 29/705 |
| 5,273,438 | A * | 12/1993 | Bradley et al. | 439/66 |
| 5,388,998 | A * | 2/1995 | Grange et al. | 439/66 |
| 6,666,690 | B2 * | 12/2003 | Ishizuka et al. | 439/66 |
| 6,722,893 | B2 * | 4/2004 | Li et al. | 439/66 |
| 2003/0040201 | A1 * | 2/2003 | Ishizuka et al. | 439/66 |
| 2003/0190825 | A1 * | 10/2003 | Sasaki | 439/66 |
| 2004/0002234 | A1 * | 1/2004 | Masao et al. | 439/66 |
| 2005/0059270 | A1 * | 3/2005 | Zheng et al. | 439/66 |

FOREIGN PATENT DOCUMENTS

| | | |
|---|---|---|
| EP | 1 283 560 | 2/2003 |
| JP | 10-12777 | 1/1998 |
| JP | 2002-93494 | 3/2002 |
| JP | 2002-170617 | 6/2002 |

* cited by examiner

*Primary Examiner*—Gary F. Paumen
(74) *Attorney, Agent, or Firm*—Morgan, Lewis & Bockius LLP

(57) ABSTRACT

A connector is adapted to be mounted on a board member. An insulative holder is formed with a through hole connecting a first side face and a second side face which is adapted to be opposed to the board member. The insulative holder accommodates a coiled spring in the through hole such that a first portion of the coiled spring is retractably projected from the first side face. A conductive plate member is attached to the holder. A first part of the plate member is disposed on the second side face of the holder such that a second portion of the coiled spring which is disposed within the through hole is brought into contact therewith. A second part of the plate member is disposed on the second side face separately from the first part, and adapted to receive solder for electrically connecting the coiled spring to a connection electrode provided on the board member. A third part of the plate member connects the first part and the second part while being extended on at least one side face which is other than the second side face.

4 Claims, 7 Drawing Sheets

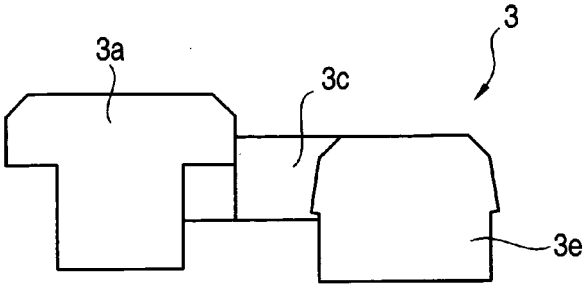
FIG. 3A
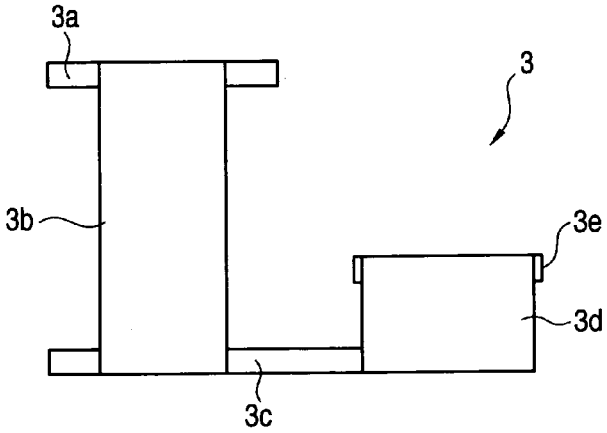
FIG. 3B
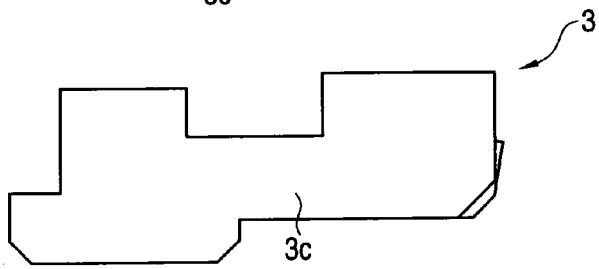
FIG. 3C
FIG. 3D
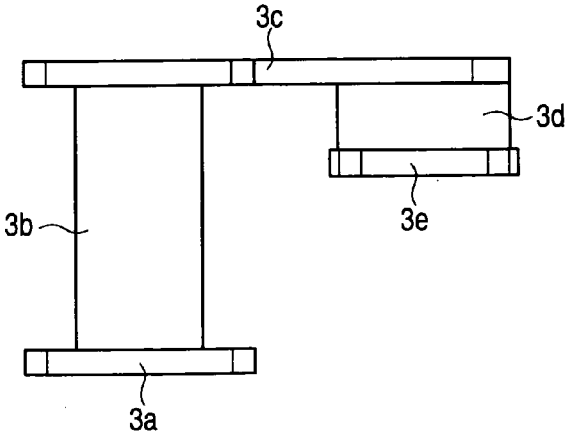
FIG. 3E
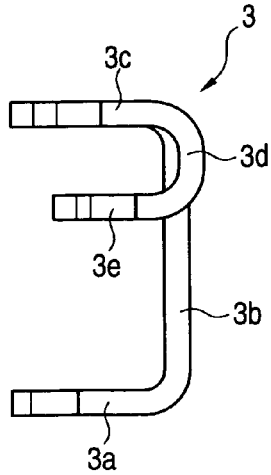

ELECTRICAL CONNECTOR PROVIDED WITH COILED SPRING CONTACT

BACKGROUND OF THE INVENTION

The present invention relates to an electrical connector provided with a coiled spring contact (CSC). The connector is typically used by being interposed between two units or two circuit boards in an electronic device such as a mobile phone, thereby to perform electrical connection between connecting electrodes provided in both such units or circuit boards.

FIG. 5 shows a connector C provided with a coiled spring contact (hereinafter referred to as a CSC type connector) which is disclosed in Japanese Patent Publication No. 2002-93494A Here is shown, as an example of use, a state where the CSC type connector C is employed for connection between a liquid crystal display board 5 and a circuit board 6 in a mobile information terminal device such as a mobile phone. Specifically, connection electrodes 5C provided on the liquid crystal display board 5 and connection electrodes 6*c* provided on the circuit board 6 are electrically connected by the connector C.

As shown in FIGS. 6A and 6B, the connector C is provided with two CSCs 1 having electrical conductivity and with an insulating holder 2 which holds these CSCs 1 in a state arranged at an interval in an axial direction thereof.

As shown in FIG. 5, each of the CSCs 1 is adapted to come into elastic contact with a pair of the connection electrodes 5*c*, 6*c* which are opposed to each other in a radial direction of the CSC. More specifically, as shown in FIGS. 5 to 7B, the CSC 1 includes a pair of end coil parts 10 adapted to come into contact with the connection electrode 6*c*, and a central coil part 12 which is displaced in a radial direction between each end coil part 10 and adapted to come into contact with another connection electrode 5*c*. The CSC 1 further includes intermediate coil parts 14, 16 between the respective end coil parts 10 and the central coil part 12. In this case, the intermediate coil parts 14, 16 and the end coil parts 10 are arranged at both sides of the central coil part 12 in such a manner that they are gradually displaced in a radial direction at substantially equal intervals, and so, an entirety of the CSC 1 has a substantially inverted V-shape, as seen in a side view.

Because respective axes of the end coil parts 10, the intermediate coil parts 14, 16, and the central coil part 12 are in parallel with one another, and a direction common to these axes is defined as the axial direction of the CSC 1. Moreover, a direction perpendicular to the axes of the end coil parts 10, the intermediate coil parts 14, 16, and the central coil part 12 is defined as the radial direction of the CSC 1.

As shown in FIGS. 6A and 6B, the holder 2 is provided with openings 20 in a rectangular shape in both upper and lower faces thereof, through which portions of the end coil parts 10 and the central coil parts 12 to be contacted with the connection electrodes (portions of an outer periphery of the CSC) are respectively protruded outward. Moreover, the holder 2 has partition walls 21, 21' for respectively interposing the CSCs 1 in the axial direction. By making a distance L between these partition walls substantially equal to a length t of the CSC 1 in the axial direction, the CSC 1 is restricted from being deformed or moved in the axial direction. Insulation between the two adjacent CSCs 1 is ensured by these partition walls 21, 21'.

When the liquid crystal board 5 and the circuit board 6 are pressed, as shown in FIG. 5, onto the connector C in a state as shown in FIG. 6B, the CSCs are elastically deformed so that a distance d between the respective axes of the central coil part 12 and the end coil parts 10 (an amount of displacement) decreases.

The partition walls 21, 21' of the holder 2 are respectively provided with projections 22 which enter into the respective end coil parts 10 of the CSCs 1 in the axial direction. Each of the projections 22 has a slant face 22*a* at an upper side and a horizontal face 22*b* at a lower side, as shown in FIG. 6B. By reducing, to some extent, a length of the projection 22 in the radial direction of the end coil part 10, the CSC 1 is made possible to move in a displacing direction within a certain range, as shown in FIG. 6B.

According to the above described structure, when the aforesaid connection electrodes 5*c*, 6*c* are pressed onto the CSC 1 held by the holder 2 so as to clamp it from above and below in the radial direction, the CSC 1 will be elastically deformed only in the displacing direction, without being deformed and moved in the axial direction.

However, in mounting and positioning the connector C on the circuit board 6 (in order to secure electrical connection with the connection electrode 6*c*) in the above described structure, soldering work is employed. In this case, there has been such a possibility that solder or flux in a melted state may be sucked up by the CSC 1 by capillary force and may intrude into gaps between the respective coil parts. Thereafter, the solder or flux in the melted state may be hardened and adhered to the coil parts, and elastically deformable performance of the CSC 1 will be lost. To avoid such a problem, it is necessary to provide a separate positioning member in mounting the connector C on the circuit board 6.

SUMMARY OF THE INVENTION

It is therefore an object of the invention to provide a CSC type connector having such a structure that elastically deformable performance of the CSC will be maintained even when soldering work is employed to secure both electrical and mechanical connection between the CSC and connection electrodes.

In order to achieve the above object, according to the invention, there is provided a connector adapted to be mounted on a board member, comprising:

a conductive coiled spring;

an insulative holder, formed with a through hole connecting a first side face and a second side face which is adapted to be opposed to the board member, the insulative holder accommodating the coiled spring in the through hole such that a first portion of the coiled spring is retractably projected from the first side face; and a conductive plate member, attached to the holder and comprising:

- a first part, disposed on the second side face of the holder such that a second portion of the coiled spring which is disposed within the through hole is brought into contact therewith;
- a second part, disposed on the second side face separately from the first part, and adapted to receive solder for electrically connecting the coiled spring to a connection electrode provided on the board member; and
- a third part, connecting the first part and the second part while being extended on at least one side face which is other than the second side face.

With this configuration, because the second portion of the coiled spring is not directly in contact with a part to which the solder is applied (the second part of the plate member), it is possible to eliminate such a drawback that melted solders or fluxes may intrude between the respective coil parts of the coiled spring by capillary force and its hardening may cause inconveniences. Moreover, the first part of the plate member which is in contact with the coiled spring is separated from the second part of the plate member to which the solder is applied by way of the third part of the plate member, and besides, the third part extends along another side face of the holder which is different from the second side face thereof where the first part and the second part of the plate member are provided. Therefore, this enables the coiled spring to reduce possibility of causing such phenomenon that the melted solder or the like flowing on the plate member may reach the first part thereof, and may further flow along the upper face thereof to be sucked up by the coiled spring.

The second side face of the holder may be formed with a notched portion in the vicinity of the second part of the plate member.

In this case, since the notched portion effectively accepts the melted solder which has flowed out from the second part of the plate member, and possibility that the melted solder may flow along the third part of the plate member to reach the first part of the plate member can be further reduced.

The first part of the coiled spring may be retractable in an axial direction thereof or in a direction which is perpendicular to an axial direction thereof.

BRIEF DESCRIPTION OF THE DRAWINGS

The above objects and advantages of the present invention will become more apparent by describing in detail preferred exemplary embodiments thereof with reference to the accompanying drawings, wherein:

FIG. 3A is a front view of a connection terminal fitting in the CSC type connector of FIG. 1A;

FIG. 3B is a bottom view of the connection terminal fitting of FIG. 3A;

FIG. 3C is a rear view of the connection terminal fitting of FIG. 3A;

FIG. 3D is a top view of the connection terminal fitting of FIG. 3A;

FIG. 3E is a side view of the connection terminal fitting of FIG. 3A;

DETAILED DESCRIPTION OF THE EMBODIMENTS

Figure 1D:
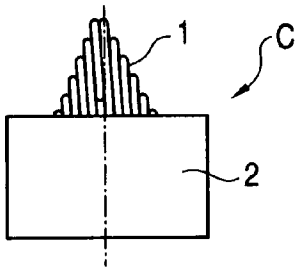
FIG. 1D is a side view of the CSC type connector of FIG. 1A.

Embodiments of the invention will be described below in detail with reference to the accompanying drawings. Members having similar structures and functions to those members in the conventional CSC type connector shown in FIGS. 5 to 7B will be denoted with the same reference numerals, and repetitive explanations for those will be omitted.

Figure 1E:
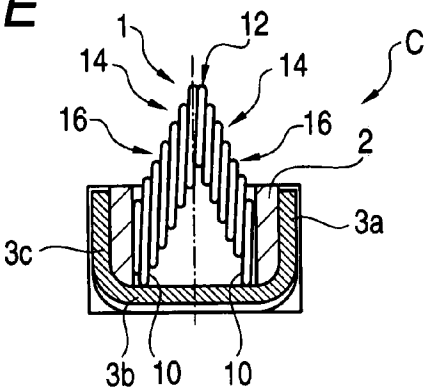
FIG. 1E is a section view taken along a line IE–IE in FIG. 1D.
Figure 1A:
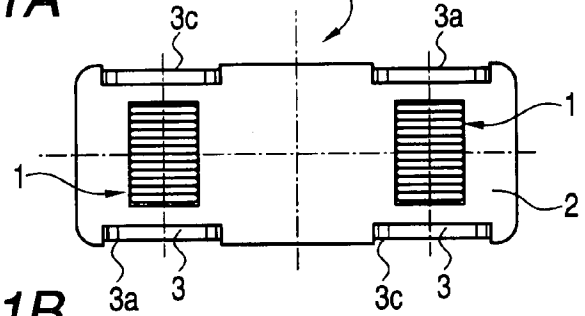
FIG. 1A is a top view of a CSC type connector according to a first embodiment of the invention.

As shown in FIG. 1A, a CSC type connector C according to a first embodiment of the invention has a structure including a pair of CSCs 1 and a pair of connection terminal fittings 3 which are provided on an insulating holder 2.

As this CSC 1, there is employed a coiled spring contact having such sizes as complying with arrangements of the corresponding connection electrodes 5*c*, 6*c*. As an example the CSC having a wire diameter of 0.1 mm, an axial length t of 0.9 mm, and a maximum distance d between the axes of the central coil part 12 and the end coil part 10 (a maximum amount of displacement) of 0.75 mm is employed. From a viewpoint of completely preventing deformation in the axial direction and a viewpoint of minimizing conductive resistance, the CSC having tight winding with no gap among the end coil parts 10, the intermediate coil parts 14, 16, and the central coil part 12 is employed.

As shown in FIGS. 3A to 3E, each of the connection terminal fittings 3 is formed by cutting and bending a plate-shaped member having electrical conductivity, and includes a first end part 3*a*, a first connecting part 3*b*, a second connecting part 3*c*, a soldering part 3*d*, and a second end part 3*e*.

Figure 2A:
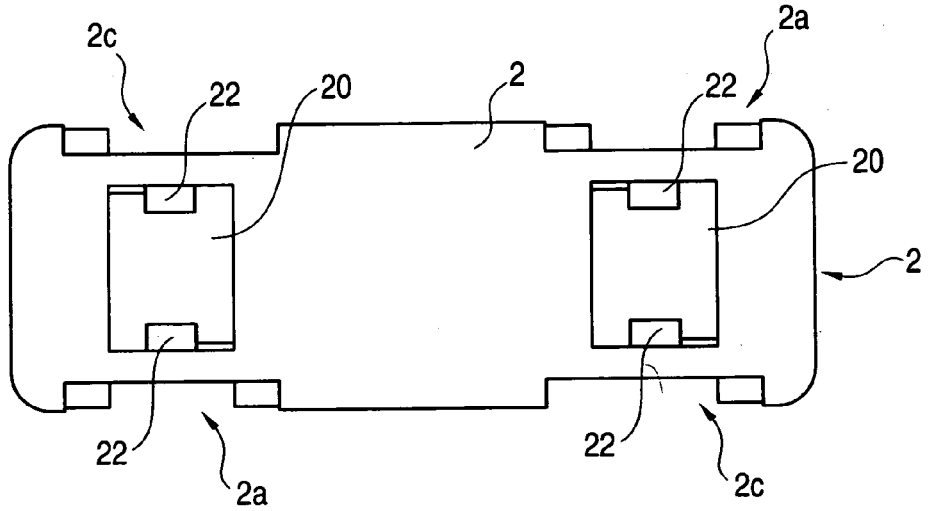
FIG. 2A is a top view of a holder in the CSC type connector of FIG. 1A.
Figure 2B:
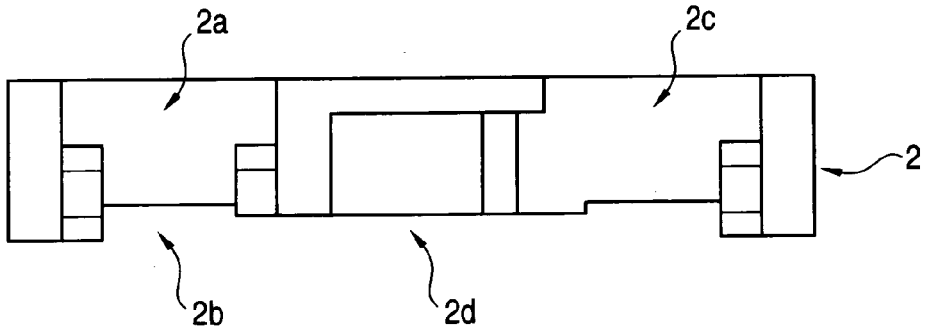
FIG. 2B is a front view of the holder of FIG. 2A.
Figure 2C:
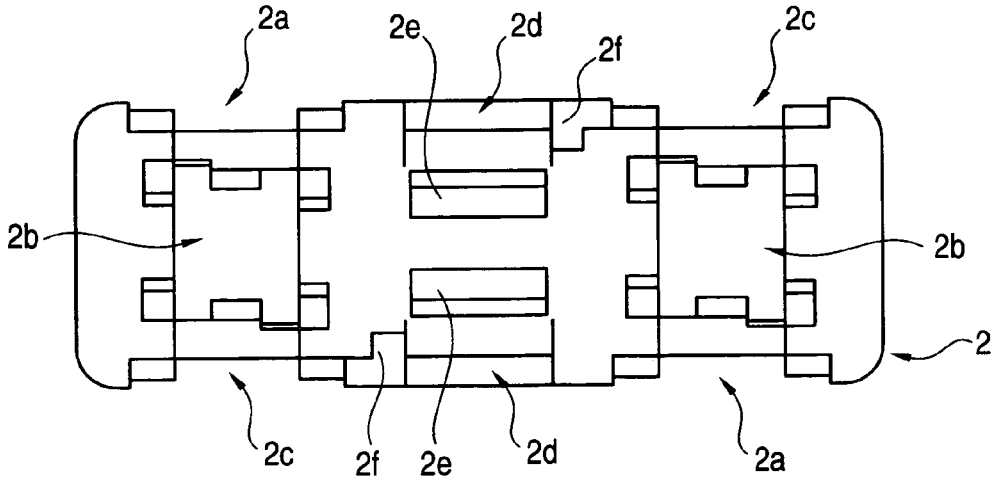
FIG. 2C is a bottom view of the holder of FIG. 2A.

As shown in FIGS. 2A to 2C, a pair of first grooves 2*a* are formed in both side faces of the holder 2 opposed to each other. A pair of second grooves 2*b* are formed in a bottom face of the holder 2 so as to respectively communicate with the first grooves 2*a* and the rectangular openings 20. A pair of third grooves 2*c* are formed in the opposed side faces of the holder 2 so as to respectively communicate with the second grooves 2*b* and so as to be adjacent to the first grooves 2*a*. A pair of fourth grooves 2*d* are formed in the bottom face of the holder 2 so as to respectively communicate with the third grooves 2*c*.

Moreover, a pair of slots 2*e* are formed in the bottom face of the holder 2 so as to respectively communicate with the fourth grooves 2*d*. Further, a pair of notches 2*f* are formed in the bottom face of the holder 2 so as to respectively communicate with the third grooves 2*c* and the fourth grooves 2*d*.

Figure 1B:
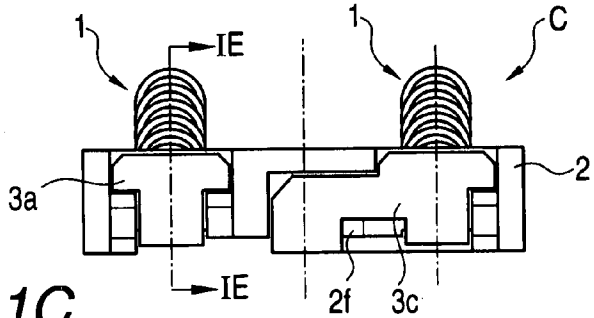
FIG. 1B is a front view of the CSC type connector of FIG. 1A.
Figure 1C:
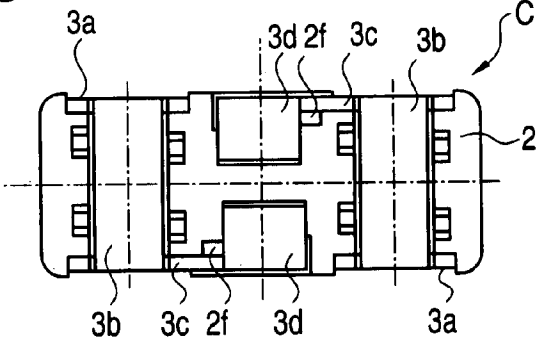
FIG. 1C is a bottom view of the CSC type connector of FIG. 1A.

Each of the connection terminal fittings 3 is fitted to the holder 2 in such a manner that the first end part 3*a*, the second connecting part 3*c* and the second end part 3*e* may be respectively inserted into the first groove 2*a*, the third groove 2*c* and the slot 2*e*. In a completely engaged state, the first connecting part 3*b* and the soldering part 3*d* of the connection terminal fitting 3 are respectively inserted into the second groove 2*b* and the fourth groove 2*d* of the holder 2. As shown in FIGS. 1A to 1C, the pair of the connection terminal fittings 3 are fitted to the holder 2 in such a manner that the first end part 3*a* of the one connection terminal fitting 3 and the second connecting part 3*c* of the other connection terminal fitting 3 are exposed on the same side face of the holder 2. Each of the notches 2*f* of the holder 2 is positioned adjacent to the second connecting part 3*c* and the soldering part 3*d* of the corresponding connection terminal fitting.

Figure 5:
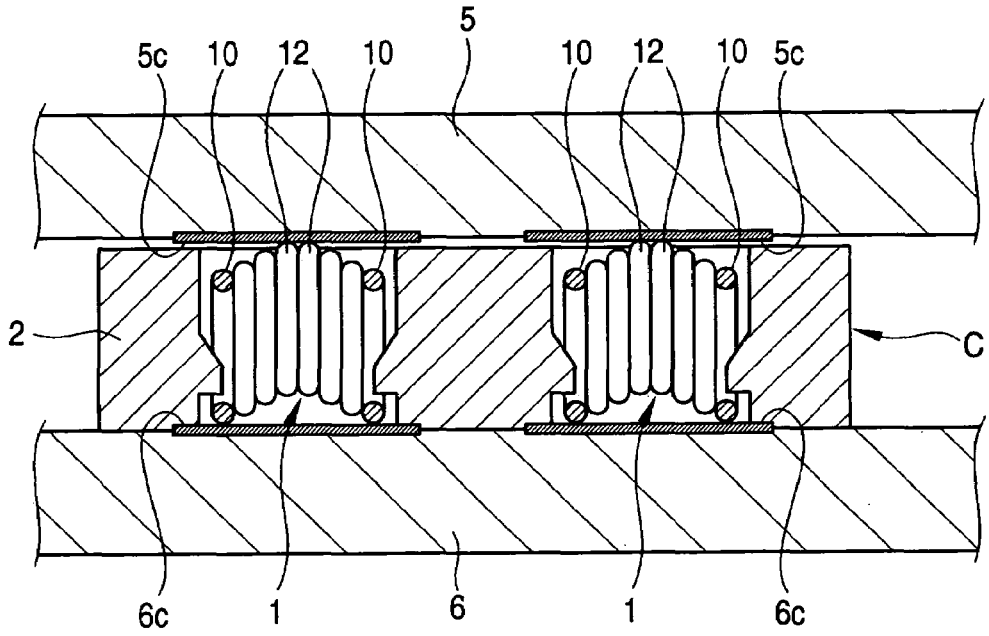
FIG. 5 is a section view showing an usage example of a conventional CSC type connector.
Figure 6A:
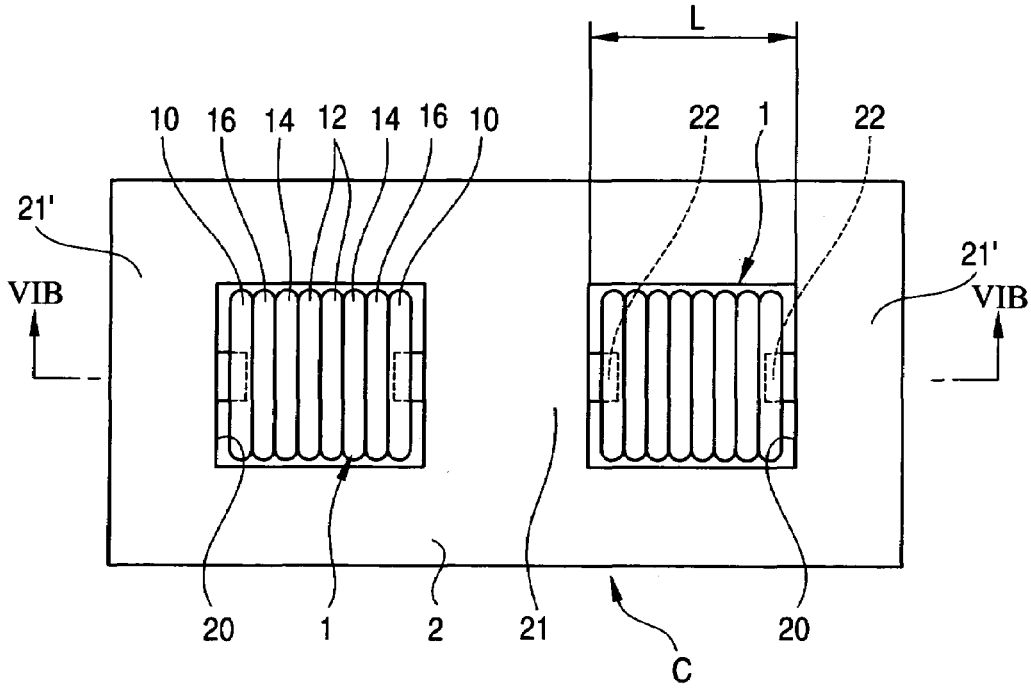
FIG. 6A is a top view of the CSC type connector of FIG. 5.
Figure 6B:
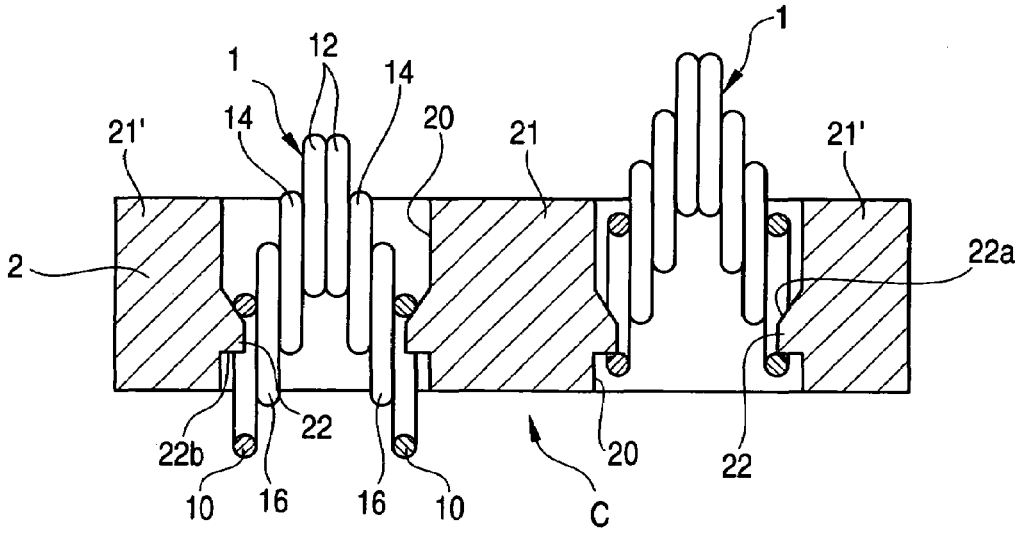
FIG. 6B is a section view taken along a line VIB–VIB in FIG. 6A.
Figure 7A:
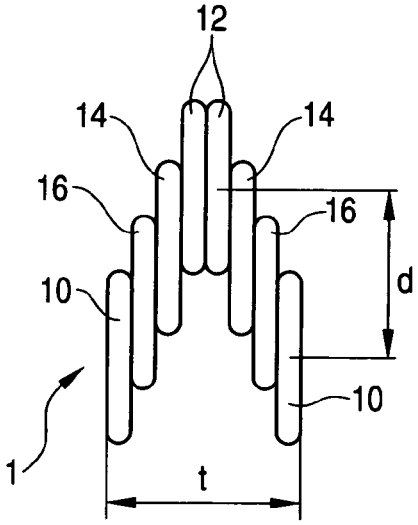
FIG. 7A is a front view of a CSC in the CSC type connector of FIG. 5.
Figure 7B:
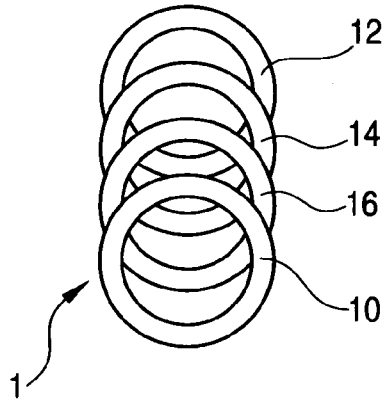
FIG. 7B is a side view of the CSC of FIG. 7A.

As shown in FIG. 1E, the end coil parts 10 of the CSC 1 are in contact with an upper face of the first connecting part 3*b* of the connection terminal fitting 3. When a mating member such as the connection electrode 5*c* of the liquid crystal display board 5 as shown in FIG. 5 is pressed onto the CSC 1, the end coil parts 10 are brought into press contact with the upper face of the first connecting part 3*b* thereby to maintain electrical connection between them. Electrical connection of the CSC with the connection electrode 6*c* of the circuit board 6 can be secured by soldering it to the soldering part 3*d* of the connection terminal fitting 3. In short, positioning and mounting of the connector C with respect to the circuit board 6, that is, electrical and mechanical connection between them, can be performed only by this soldering work, and therefore the mounting process can be simplified.

On this occasion, because the end coil parts 10 are not directly in contact with the soldered areas according to the above described structure, it is possible to eliminate such a drawback that melted solders or fluxes may intrude between the respective coil parts of the CSC 1 by capillary force and thereafter hardened solder or flux may cause inconveniences. Moreover, the first connecting part 3*b* which is in contact with the CSC 1 is separated from the soldering part 3*d* by way of the second connecting part 3*c*, and besides, the second connecting part 3*c* extends along another side face of the holder 2 which is different from the bottom face of the holder 2 where the first connecting part 3*b* and the soldering part 3*d* are provided. Therefore, this embodiment enables the CSC 1 to reduce possibility of causing such phenomenon that the melted solder or the like moving on the connection terminal fitting 3 may reach the first connecting part 3*b*, and may further flow along the upper face thereof to be sucked up by the CSC 1. It is also possible to arrange the second connecting part 3*c* in such a manner that it extends along a plurality of the side faces of the holder 2 to reach the first connecting part 3*b*. In this manner, the probability of causing the above described phenomenon can be further reduced.

Additionally, the notch 2*f* effectively accepts the melted solder which has flowed out from the soldering part 3*d*, and probability that the melted solder may flow along the second connecting part 3*c* to reach the first connecting part 3*b* can be further reduced.

As described, according to the structure of the invention, the elastically deformable performance of the CSC will be maintained, while employing the soldering work capable of securing both electrical and mechanical connection between the CSC and the connection electrodes. Therefore, it is possible to attain cost reduction of components and improvement of handling in assembling process.

Next, a second embodiment of the invention will be described. Members having similar structures and functions to those members in the first embodiment will be denoted with the same reference numerals, and overlapped descriptions will be omitted.

Figure 4A:
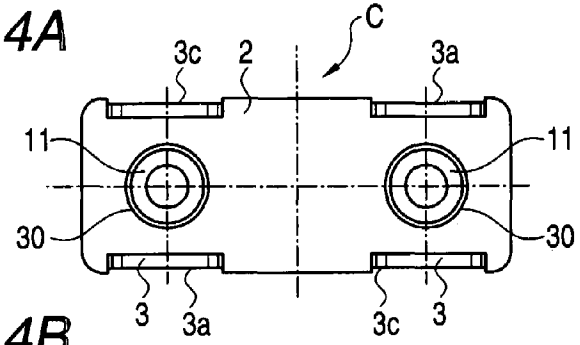
FIG. 4A is a top view of a CSC type connector according to a second embodiment of the invention.
Figure 4B:
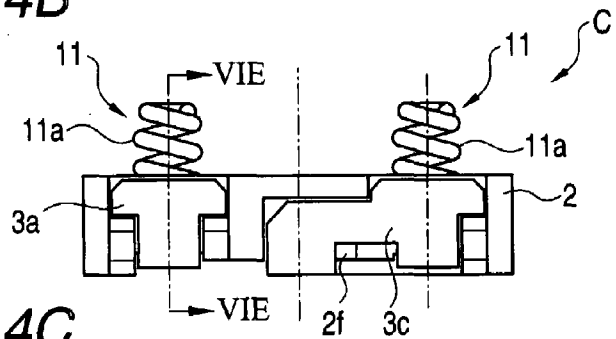
FIG. 4B is a front view of the CSC type connector of FIG. 4A.
Figure 4C:
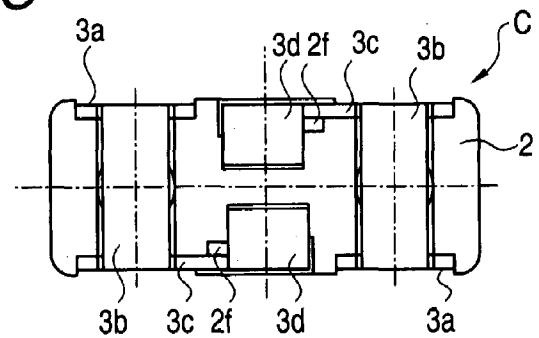
FIG. 4C is a bottom view of the CSC type connector of FIG. 4A.
Figure 4D:
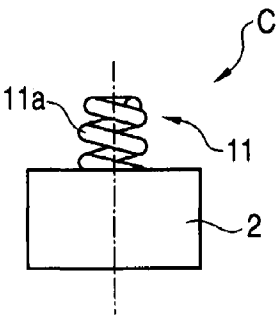
FIG. 4D is a side view of the CSC type connector of FIG. 4A.

As shown in FIG. 4A, a CSC type connector C according to the second embodiment of the invention has a structure including a pair of CSC 11 and a pair of connection terminal fittings 3 which are provided on an insulating holder 2. The CSC 11 in this embodiment is formed as a conical coiled spring having a small diameter part 11*a* and a large diameter part 11*b* (as disclosed in Japanese Patent Publication No. 2002-170617A, for example).

Figure 4E:
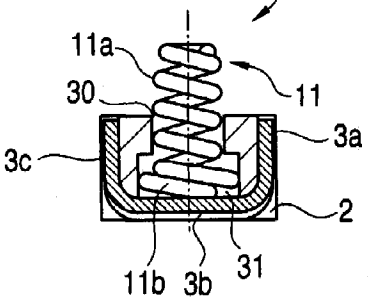
FIG. 4E is a section view taken along a line IVE–IVE in FIG. 4D.

The holder 2 is formed with circular openings 30 in an upper face thereof, which are communicated with spaces 31 formed inside the holder 2. As shown in FIG. 4E, the space 31 is so dimensioned as to contain the large diameter part 11*b* of the above described conical CSC 11, and only the small diameter part 11*a* projects upwardly from the opening 30. A lower end of the large diameter part 11*b* is in contact with an upper face of the first connecting part 3*b* of the connection terminal fitting 3. When a mating member such as the connection electrode 5*c* of the liquid crystal display board 5 as shown in FIG. 5 is pressed onto the CSC 1, the lower end of the large diameter part 11*b* is brought into press contact with the upper face of the first connecting part 3*b* thereby to maintain electrical connection between them.

It is to be noted that the above described structure has been given only by way of example, and appropriate change or modification can be made within a scope prescribed in the appended claims. For example, the number of the CSCs to be provided on a piece of the connector C is not limited to two, but one or more than three CSCs may be provided.

What is claimed is:

1. A connector adapted to be mounted on a board member, comprising:

a conductive coiled spring;

an insulative holder, formed with a through hole connecting a first side face and a second side face which is adapted to be opposed to the board member, the insulative holder accommodating the coiled spring in the through hole such that a first portion of the coiled spring is retractably projected from the first side face; and a conductive plate member, attached to the holder and comprising:

a first part, disposed on the second side face of the holder such that a second portion of the coiled spring which is disposed within the through hole is brought into contact therewith;

a second part, disposed on the second side face separately from the first part, and adapted to receive solder for electrically connecting the coiled spring to a connection electrode provided on the board member; and a third part, connecting the first part and the second part while being extended on at least one side face which is other than the second side face.

2. The connector as set forth in claim 1, wherein the second side face of the holder is formed with a notched portion in the vicinity of the second part of the plate member.

3. The connector as set forth in claim 1, wherein the first part of the coiled spring is retractable in a direction which is perpendicular to an axial direction thereof.

4. The connector as set forth in claim 1, wherein the first part of the coiled spring is retractable in an axial direction thereof.

* * * * *